US012628952B2

(12) United States Patent
Zou

(10) Patent No.: US 12,628,952 B2
(45) Date of Patent: May 19, 2026

(54) ELECTRIC SWING

(71) Applicant: Suzhou Lucky Intelligent Technology Co., Ltd., Kunshan (CN)

(72) Inventor: Xueming Zou, Kunshan (CN)

(73) Assignee: Suzhou Lucky Intelligent Technology Co., Ltd. (CN)

( * ) Notice: Subject to any disclaimer, the term of this patent is extended or adjusted under 35 U.S.C. 154(b) by 162 days.

(21) Appl. No.: 18/784,105

(22) Filed: Jul. 25, 2024

(65) Prior Publication Data

US 2025/0325107 A1 Oct. 23, 2025

(30) Foreign Application Priority Data

Apr. 22, 2024 (CN) ..... 202410480403.4

(51) Int. Cl.
*A47D 13/10* (2006.01)
*A47C 3/00* (2006.01)
*A47C 3/025* (2006.01)

(52) U.S. Cl.
CPC ..... *A47C 3/0255* (2013.01); *A47C 3/0251* (2018.08); *A47D 13/10* (2013.01)

(58) Field of Classification Search
CPC ..... A47C 3/0251; A47C 3/0255; A47D 13/10
See application file for complete search history.

(56) References Cited

U.S. PATENT DOCUMENTS 295,275 A * 3/1884 Oaks ..... A47C 3/0255 5/120
1,458,049 A * 6/1923 Grieshaber ..... A47C 3/0255 472/119
3,842,450 A * 10/1974 Pad ..... H01H 3/16 5/904
4,351,524 A * 9/1982 Gomes ..... A47C 3/0255 248/188
5,139,462 A * 8/1992 Gabe ..... A47C 3/0251 5/109
5,803,818 A * 9/1998 Tseng ..... A47C 3/0255 472/125
6,001,021 A * 12/1999 Battaglia ..... A47C 3/0255 472/125

(Continued)

FOREIGN PATENT DOCUMENTS

CN 111904193 A * 11/2020 ..... A47C 7/624
ES 2663207 A1 * 4/2018 ..... A47D 13/105

(Continued)

*Primary Examiner* — Timothy J Brindley

(57) ABSTRACT

An electric swing is provided, which includes support frames, wherein fixing brackets are arranged at top ends of the support frames, a transmission shaft is arranged at ends of the fixing brackets in a sleeved manner, a power device is arranged at one end of the transmission shaft, fixing plates are arranged on the transmission shaft, and fixing assemblies are arranged on the fixing plates; each fixing assembly specifically comprises a rope, a fixing disc and two rope anchoring pins, wherein a T-bar is arranged on the fixing disc, the two rope anchoring pins are arranged symmetrically, the rope anchoring pins are located below the fixing plate and form a triangle together with the fixing disc, the rope is mounted on the fixing disc and located between the rope anchoring pins, and circular rings are fixedly arranged at two ends of a lower side of the T-bar.

6 Claims, 3 Drawing Sheets

(56) References Cited

U.S. PATENT DOCUMENTS

| | | | | |
|---|---|---|---|---|
| 6,343,838 | B1 * | 2/2002 | Bagshaw | A63G 9/00 297/278 |
| 6,715,831 | B1 * | 4/2004 | Tseng | A47C 3/0255 297/320 |
| 7,699,711 | B2 * | 4/2010 | Tseng | A47C 3/0255 472/125 |
| 9,789,409 | B1 * | 10/2017 | Yakos | A63G 9/12 |
| 2005/0107173 | A1 * | 5/2005 | Pelletier | A63G 9/12 472/118 |

FOREIGN PATENT DOCUMENTS

| | | | | |
|---|---|---|---|---|
| KR | 20100070066 | A * | 6/2010 | A47C 7/66 |
| KR | 20170122512 | A * | 11/2017 | A47C 11/00 |
| KR | 20240020053 | A * | 2/2024 | A47C 3/0255 |

* cited by examiner

ELECTRIC SWING

CROSS-REFERENCE TO RELATED APPLICATIONS

This application claims priority to Chinese Application No. 202410480403.4, having a filing date of Apr. 22, 2024, the entire contents of which are hereby incorporated by reference.

TECHNICAL FIELD

The invention relates to the technical field of swings, in particular to an electric swing.

BACKGROUND OF THE INVENTION

Swings are common sports equipment that can promote the development of human vestibular organs, improve balance, relax the body, bring enjoyment, calm the mind and body, and regulate the psychological state. The swing comprises support frames, ropes or swing arms, and a seat, and the seat is hung on the support frame by means of the ropes or the swing arms.

The ropes adopted by traditional swings are soft ropes, wherein upper ends of the soft ropes are hung on the support frames, and the seat is hung at lower ends of the soft ropes. The swing starts to swing or stops swinging under the action of an external force and keeps swinging under the effect of inertia, and users sitting on the swing cannot easily control the start and stop of swinging of the swing or regulate the swing speed of the swing by themselves. Users cannot autonomously control the swing to stop or slow down in case of an emergency or when the users feel unwell, leading to an accident; the traditional swing swings under the effect of inertia, and users cannot effectively control or regulate the swing speed and amplitude of the swing by themselves, leading to poor comfort or usage experience; in addition, when the traditional swing is used, the support frames bear all the gravity load of the seat, and when the swing swings, the top ends of the ropes will shake severely with respect to support rods of the support frames, leading to a decrease of the service life of the support frames or the ropes.

Because the ropes adopted by traditional swings are soft ropes, power will not be effectively transmitted to the seat or a plate to drive the seat or plate to swing when the soft ropes are driven electrically, and start and stop of swinging of the swing cannot be effectively controlled, or the swing speed or amplitude of the swing cannot be regulated.

In view of this, the inventor proposes an electric swing to solve the above problems.

SUMMARY OF THE INVENTION

To solve the above problems, the objective of the invention is to provide an electric swing.

To solve the above technical problems, the invention adopts the following technical solution: an electric swing comprises support frames, wherein fixing brackets are arranged at top ends of the support frames, a transmission shaft is arranged at ends of the fixing brackets in a sleeved manner, a power device is arranged at an end of the transmission shaft, fixing plates are arranged on the transmission shaft, and fixing assemblies are arranged on the fixing plates; each fixing assembly specifically comprises a rope, a fixing disc and two rope anchoring pins, wherein a T-bar is arranged on the fixing disc or the fixing plate, the two rope anchoring pins are arranged symmetrically, the rope anchoring pins are located below the fixing plate and form a triangle together with the fixing disc, the rope is mounted on the fixing disc and located between the rope anchoring pins, circular rings are fixedly arranged at two ends of a lower side of the T-bar, two ends of the rope penetrate through the two circular rings at the two ends of the lower side of the T-bar, and one or two lower ends of the rope are connected to a support plate.

Preferably, a triangle or polygon is formed by the rope and the lower side, connected with the rope, of the T-bar, angles (such as 30°-120°) are formed between a top of the T-bar and the two ends of the rope, angles (such as 30°-120°) are formed between a lower portion of the T-bar and the two ends of the rope, and a quadrangle or triangle is formed by the rope below the T-bar and the support plate.

Preferably, the rope penetrates through the circular rings at the two ends of the lower side of the T-bar, and angles (such as 30°-120°) are formed between the two long ends of the rope below the T-bar and the lower long side of the T-bar.

Preferably, the T-bar is fixed to the fixing disc, the fixing plate or the transmission shaft, the fixing disc is fixed to the fixing plate, the rope anchoring pins are fixed to the fixing plate, and the fixing plate is fixed to the transmission shaft.

Preferably, the power device comprises a power supply, a motor, a gearbox and an electric control device and is fixed to the support frame or the top end of the fixing frame.

Preferably, an upper end of the rope is connected to the fixing disc or is wound around or fixed to the fixing disc.

Compared with the prior art, the invention has the following beneficial effects:

1. In the invention, quasi-rigid bodies are formed by the T-bar and the rope and by the T-bar, the rope and the support plate, such that power of the transmission shaft can be effectively transmitted to the support plate to drive the support plate to move synchronously with the transmission shaft, and the swing is effectively driven by the support plate to swing forward and backward;
2. In the invention, when a force is applied to the rope, the T-bar can generate an upward component force to support the transmission shaft or the support frame at the top so as to reduce the load applied to the transmission shaft or the support frame, such that the transmission shaft or the support frame can bear a larger load from the support plate to allow the swing to carry more persons or loads at a time, thus effectively improving practicability.

BRIEF DESCRIPTION OF DRAWINGS

To more clearly explain the technical solutions of the embodiments of the invention or the prior art, drawings used for describing the embodiments of the invention or the prior art are briefly introduced below. Obviously, the drawings in the following description merely illustrate some embodiments of the invention, and those ordinarily skilled in the art can obtain other drawings according to the following ones without creative labor.

Figure 1:
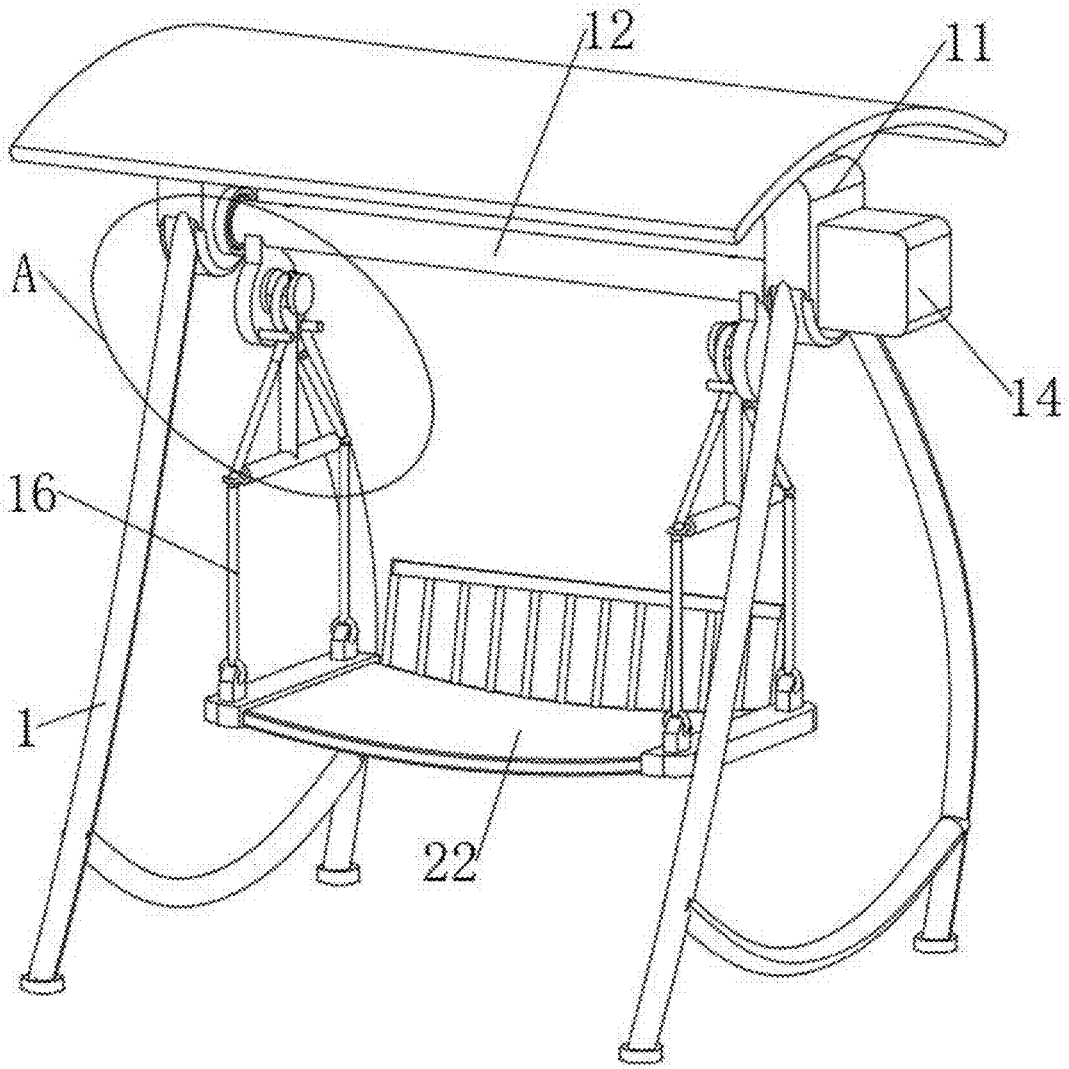
FIG. 1 is an overall structural view of the invention.
Figure 2:
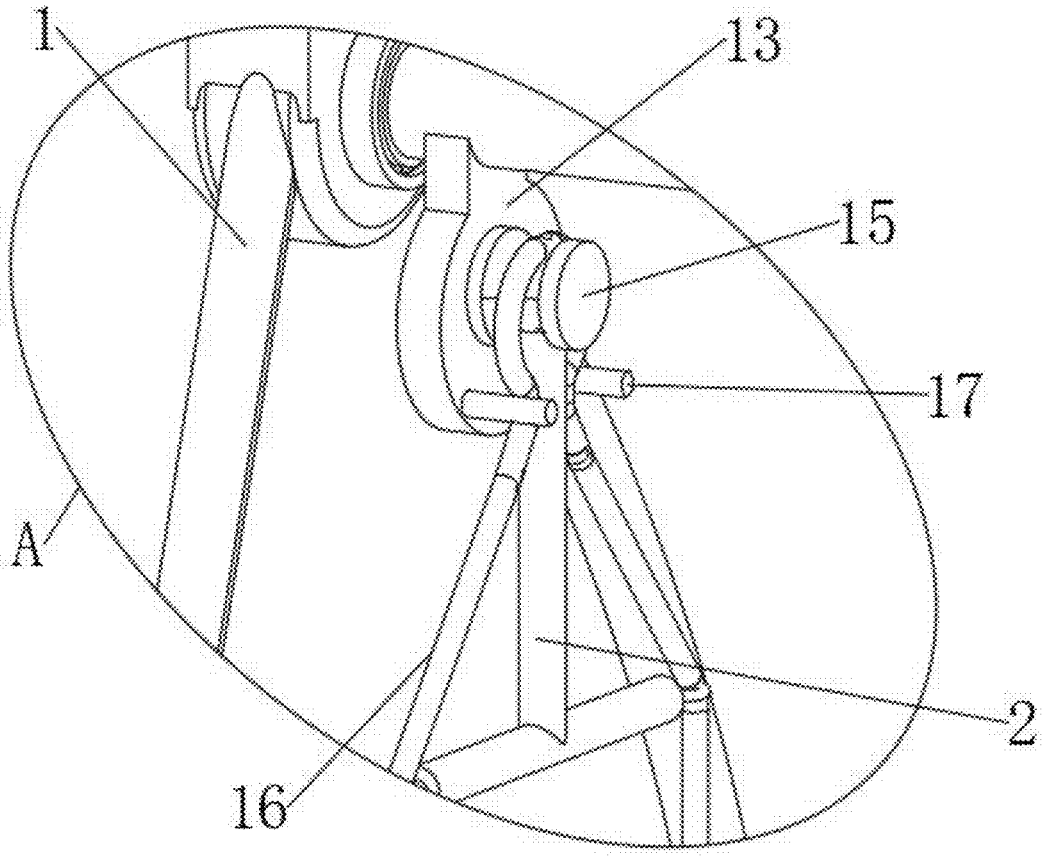
FIG. 2 is an enlarged structural view of part A in FIG. 1.

In the FIGS.: 1, support frame; 11, fixing frame; 12, transmission shaft; 13, fixing plate; 14, power device; 15, fixing disc; 16, rope; 17, rope anchoring pin; 2, T-bar; 21, circular ring; 22, support plate.

DETAILED DESCRIPTION OF THE INVENTION

The technical solutions of the embodiments of the invention will be clearly and completely described below in conjunction with the accompanying drawings of the embodiments. Obviously, the embodiments in the following description are merely illustrative ones, and are not all possible ones of the invention. All other embodiments obtained by those ordinarily skilled in the art based on the following ones without creative labor should also fall within the protection scope of the invention.

As shown in FIG. 1-FIG. 6, the invention provides an electric swing, comprising support frames 1, wherein fixing brackets 11 are arranged at top ends of the support frames 1, a transmission shaft 12 is arranged at ends of the fixing brackets 11 in a sleeved manner, a power device 14 is arranged at one end of the transmission shaft 12 and drives the transmission shaft 12 to rotate, fixing plates 13 are arranged on the transmission shaft 12, and fixing assemblies are arranged on the fixing plates 13.

Each fixing assembly comprises a rope 16, a fixing disc 15 and two rope anchoring pins 17, wherein a T-bar 2 is arranged on the fixing disc 15, the two rope anchoring pins 17 are arranged symmetrically, the rope anchoring pins 17 are located below the fixing plate 13 and form a triangle together with the fixing disc 15, the rope 16 is mounted on the fixing disc 15 and located between the rope anchoring pins 17, circular rings 21 are fixedly arranged at two ends of a lower side of the T-bar 2, two ends of the rope penetrate through the circular rings 21 at the two ends of the lower side of the T-bar 2 and are clamped in grooves of the circular rings 21 to be prevented from disengagement, and two lower ends of the rope 16 are connected to a support plate 22.

A triangle is formed by the rope 16 and the lower side, connected with the rope, of the T-bar 2, and angles (such as 30°-120°) are formed between the top of the T-bar 2 and the two ends of the rope 16.

The rope 16 penetrates through the circular rings 21 at the two ends of the lower side of the T-bar 2, and angles (such as 30°-120°) are formed between the two long ends of the rope 16 below the T-bar 2 and the lower long side of the T-bar 2.

The T-bar 2 is fixed to the fixing disc 15, the fixing disc 15 is fixed to the fixing plate 13, the rope anchoring pins 17 are fixed to the fixing plate 13, and the fixing plate 13 is fixed to the transmission shaft 12.

The power device 14 comprises a power supply, a motor, a gearbox and an electric control device and is fixed to the support frame 1 or the top end of the fixing frame 11, power output by the gearbox in the power device 14 is transmitted to the transmission shaft 12, and the transmission shaft drives the fixing plate 13, the fixing disc 15 and the T-bar 2 to drive the rope 16 and the support plate 22 to swing.

An upper end of the rope 16 is connected to the fixing disc 15 or is wound around or fixed to the fixing disc 15, and the support plate 22 is a plate, a seat, a basket, a bed, a fabric or other man-riding devices.

Figure 3:
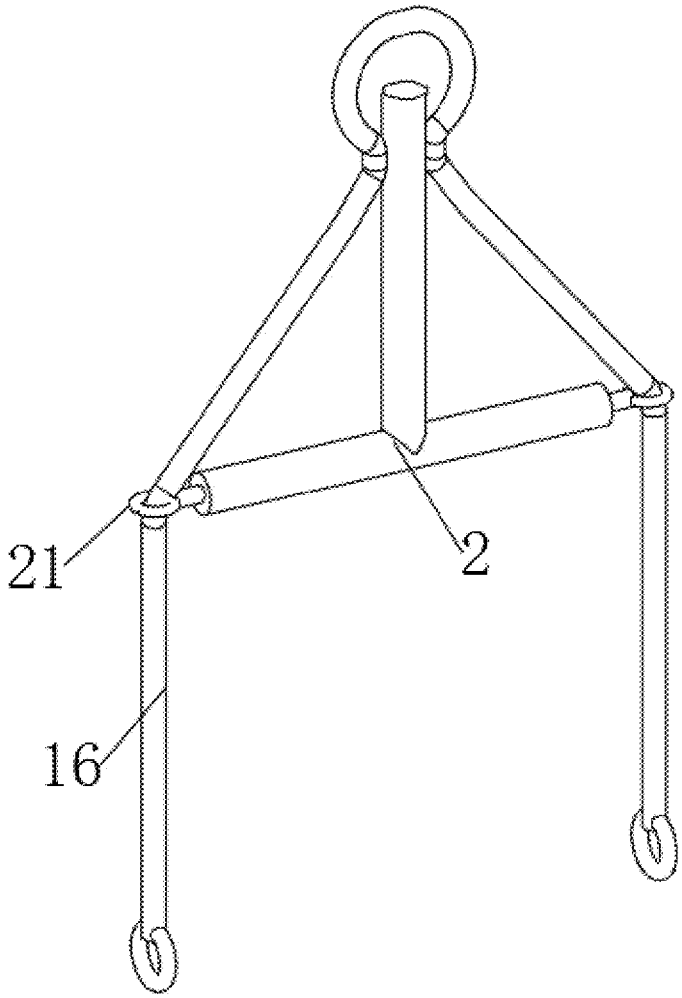
FIG. 3 is a structural view of a rope according to the invention.

Working principle: in the invention, the T-bar 1 is arranged, and when the rope 16 bears a downward load from the support plate 22, quasi-rigid bodies can be formed by the T-bar 2 and the rope 16 and by the T-bar 2, the rope 16 and the support plate 22, such that power of the transmission shaft 12 can be effectively transmitted to the support plate 22 to drive the support plate 22 to move synchronously with the transmission shaft 12, and the swing is effectively driven by the support plate 22 to swing forward and backward;

Moreover, when a force is applied to the rope 16, the T-bar 2 can generate an upward component force to support the transmission shaft 12 or the support frame 1 at the top so as to reduce the load applied to the transmission shaft 12 or the support frame 1 or allow the transmission shaft 12 or the support frame 1 to bear a larger load from the support plate 22, such that the swing can carry more persons or loads at a time in use, thus effectively improving practicability;

One rope 16 is connected to the two ends of the support plate 22, and when the swing is assembled, the rope 16 just needs to be wound across the fixing plate 15 and the two rope anchoring pins 17 sequentially, as shown in FIG. 3, such that the operation steps are simple, the overall assembly efficiency is high, and operators can assemble the swing easily.

Obviously, those skilled in the art can make various modifications and transformations to the invention without deviating from the spirit and scope of the invention. If these modifications and transformations of the invention belong to the technical scope of the claims of the invention and their equivalents, the invention is intended to include all these modifications and transformations.

The invention claimed is:

1. An electric swing, comprising support frames (1), wherein fixing brackets (11) are arranged at top ends of the support frames (1), a transmission shaft (12) is arranged at ends of the fixing brackets (11) in a sleeved manner, a power device (14) is arranged at an end of the transmission shaft (12) and drives the transmission shaft (12) to rotate, fixing plates (13) are arranged on the transmission shaft (12), and fixing assemblies are arranged on the fixing plates (13);

each said fixing assembly specifically comprises a rope (16), a fixing disc (15) and two rope anchoring pins (17), wherein a T-bar (2) is arranged on the fixing disc (15), the two rope anchoring pins (17) are arranged symmetrically, the rope anchoring pins (17) are located below the fixing plate (13) and form a triangle together with the fixing disc (15), the rope (16) is mounted on the fixing disc (15) and located between the rope anchoring pins (17), circular rings (21) are fixedly arranged at two ends of a lower side of the T-bar (2), two ends of the rope (16) penetrate through the two circular rings (21) at the two ends of the lower side of the T-bar (2) and are clamped in grooves of the circular rings (21) to be prevented from disengagement, and one or two lower ends of the rope (16) are connected to a support plate (22).

2. The electric swing according to claim 1, wherein a triangle or polygon is formed by the rope (16) below a top of the T-bar (2) and the lower side, connected with the two ends of the rope (16), of the T-bar (2), and a quadrangle or triangle is formed by the rope (16) below the T-bar (2) and the support plate (22) connected with the two lower ends of the rope (16).

3. The electric swing according to claim 1, wherein the rope (16) penetrates through the circular rings (21) at the two ends of the lower side of the T-bar (2), and the two long ends of the rope (16) below the T-bar (2) are connected to the support plate (22) to form a quadrangle or triangle.

4. The electric swing according to claim 1, wherein the T-bar (2) is fixed to the fixing disc (15), the fixing disc (15) is fixed to the fixing plate (13), the rope anchoring pins (17) are fixed to the fixing plate (13), and the fixing plate (13) is fixed to the transmission shaft (12).

5. The electric swing according to claim 1, wherein the power device (14) comprises a power supply, a motor, a gearbox and an electric control device and is fixed to the support frame (1) or the top end of the fixing frame (11), power output by the gearbox in the power device (14) is transmitted to the transmission shaft (12), and the transmission shaft drives the fixing plate (13), the fixing disc (15) and the T-bar (2) to drive the rope (16) and the support plate (22) to swing.

6. The electric swing according to claim 1, wherein an upper end of the rope (16) is connected to the fixing disc (15) or is wound around or fixed to the fixing disc (15), and the support plate (22) is a plate, a seat, a basket, a bed, a fabric or other man-riding devices.

* * * * *